US008025206B2

(12) United States Patent
Wisecarver et al.

(10) Patent No.: US 8,025,206 B2
(45) Date of Patent: Sep. 27, 2011

(54) BULK CONTAINER FOR LIQUID AND SEMI-LIQUID FLUID

(75) Inventors: Mark Anthony Wisecarver, Morristown, TN (US); Michael A. Churvis, Germantown, TN (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 12/846,071

(22) Filed: Jul. 29, 2010

(65) Prior Publication Data

US 2010/0308053 A1 Dec. 9, 2010

Related U.S. Application Data

(63) Continuation-in-part of application No. 12/471,949, filed on May 26, 2009, and a continuation-in-part of application No. 12/471,904, filed on May 26, 2009.

(51) Int. Cl.
*B65D 5/12* (2006.01)
*B65D 43/08* (2006.01)

(52) U.S. Cl. ..... 229/109; 229/122.32; 229/122.33; 229/125.22; 229/125.26

(58) Field of Classification Search ..... 229/109, 229/122.32, 122.33, 122.34, 125.22, 125.26, 229/920, 195, 197, 939; 206/386, 600
See application file for complete search history.

(56) References Cited

U.S. PATENT DOCUMENTS 2,946,494 A 7/1960 Kuss
2,962,159 A * 11/1960 Sheard ..... 229/125.22
3,012,660 A * 12/1961 Sheldon, Jr. ..... 229/120.32
3,433,400 A * 3/1969 Hawkins ..... 229/109
3,907,194 A * 9/1975 Davenport et al. ..... 229/109
3,937,392 A * 2/1976 Swisher ..... 229/122.33
4,013,168 A * 3/1977 Bamburg et al. ..... 206/386
4,094,455 A * 6/1978 Bamburg et al. ..... 229/122.33
4,208,954 A * 6/1980 Chase ..... 229/125.26
4,341,337 A * 7/1982 Beach et al. ..... 229/122.32
4,359,182 A * 11/1982 Perkins, Jr. ..... 229/125.26
4,421,253 A * 12/1983 Croley ..... 229/117.35
4,516,692 A 5/1985 Croley
4,585,143 A * 4/1986 Fremow et al. ..... 206/386
4,623,075 A 11/1986 Riley
4,666,059 A 5/1987 Nordstrom
4,742,951 A * 5/1988 Kelly et al. ..... 229/109
4,771,917 A 9/1988 Heaps, Jr. et al.
4,850,506 A 7/1989 Heaps, Jr. et al.
4,890,756 A 1/1990 Waltke
4,919,306 A * 4/1990 Heaps et al. ..... 229/122.34
5,050,775 A 9/1991 Marquardt
5,069,359 A * 12/1991 Liebel ..... 229/117.3
(Continued)

*Primary Examiner* — Gary Elkins
(74) *Attorney, Agent, or Firm* — Matthew M. Eslami

(57) ABSTRACT

A bulk container for fluid materials comprises a bin having a plurality of interconnected sidewall panels, a closed bottom, and an open top. A rim around the top of the bin defines a downwardly facing shoulder. A lid covers the open top and has elongated depending skirt panels extending downwardly past the shoulder. A clamping band is tightened around the lid skirt below the shoulder to secure the lid to the bin. Notches in an outer surface of the rim receive bendable locking strips on the lid skirt to lock the lid in position on the bin, and locking tongues on a first skirt panel are engageable in respective locking slots in an adjacent second skirt panel to hold the skirt panels in their operative downwardly folded positions. A tray and liner insert may be positioned in the bin, and a fluid-containing bag may be placed in the liner.

19 Claims, 13 Drawing Sheets

U.S. PATENT DOCUMENTS

| | | | |
|---|---|---|---|
| 5,348,186 | A | 9/1994 | Baker |
| 5,351,849 | A | 10/1994 | Jagenburg et al. |
| 5,474,203 | A | 12/1995 | Baker |
| 5,803,346 | A | 9/1998 | Baker et al. |
| 7,172,108 | B2 | 2/2007 | Ingalls |
| 7,275,679 | B2 | 10/2007 | Ingalls |
| 2003/0160092 | A1 | 8/2003 | Philips et al. |
| 2005/0051611 | A1 | 3/2005 | Ingalls |
| 2006/0180643 | A1 | 8/2006 | Stephanson |
| 2008/0023359 | A1 | 1/2008 | Churvis et al. |

* cited by examiner

BULK CONTAINER FOR LIQUID AND SEMI-LIQUID FLUID

CROSS REFERENCE TO RELATED APPLICATIONS

This application claims priority to U.S. Non-provisional patent application Ser. No. 12/471,949, filed on 26 May 2009, and to U.S. Non-provisional patent application Ser. No. 12/471,904, filed on 26 May 2009, all of which are hereby incorporated hereinto by reference as if fully restated herein.

FIELD OF THE INVENTION

This invention relates to bulk shipping containers, and more particularly to a multi-sided shipping container in drum form made of corrugated fiberboard to replace the plastic, solid fiber or metal cylindrical shipping drums conventionally used, wherein the container has an improved lid that resists dislodgement in the event the container is tipped over or dropped.

BACKGROUND OF THE INVENTION

Containers of relatively large size are commonly used for the bulk transportation and storage of materials such as, e.g., solvents, lubricants, inks, dyes, abrasives, adhesives, resin, insecticides, dry chemicals, powdered detergents, grains, frozen concentrate, meat, spices, sauces, and the like. These bulk containers must be capable of withstanding the weight of the contents as well as the rough handling to which they may be subjected. Further, they should be capable of being stacked on top of one another and should remain securely closed in the event they are tipped over or dropped.

A bulk container commonly in use comprises a cylindrical drum made of solid fiber, plastic or metal. These drums typically are provided in sizes from 35 to 55 gallons and have metal rings or bands at their top and bottom ends, with a lid or cover removably secured in place by a clamping band. The drums can be picked up and transported by mechanized equipment, including engaging the tines of a forklift under the rim provided by the band at the top of the drum. They also may be manually moved around on a supporting surface by tilting the drum and rolling the bottom edge of it along the supporting surface.

Depending upon the product stored in them, when full these cylindrical drums can weigh upwards of 500 pounds. Accordingly, manual handling of them can be difficult, especially when they are tilted and rolled along a supporting surface, since the metal band at the top does not provide much surface to grip and control the drum. Moreover, the circular configuration at the bottom end enables momentum or inertia to be built up when the drum is being rolled, making it difficult to control.

Further, due to their construction, cylindrical drums must be fully assembled and shipped to a user in their normal usable configuration. This requires substantial storage and shipping space for empty drums, adding to freight and warehousing costs. In addition, these types of drums are not easily recyclable.

To address these concerns with prior art containers, applicant developed a multi-sided bulk shipping container for liquids and semi-liquid fluids in drum form made of corrugated fiberboard and that generally looks, handles, stores, ships, and can be received like the fiber, plastic or steel cylindrical drums conventionally used. These containers are described in Applicant's prior copending patent application Ser. Nos. 12/471,904, filed May 26, 2009 and 12/471,949, filed May 26, 2009, the disclosures of which are incorporated in full herein by reference. The containers described in those applications comprise multi-sided bins having an integral rim at their upper end, and a lid that is placed over the open upper end to close it. Locking means on the bin and lid interlock to secure the lid to the bin. The locking means includes inwardly bendable locking strips on the lid skirt that engage in notches in the rim, and a locking band placed around the lid skirt to press the bendable locking strips into the notches and clamp the lid to the rim. The containers may be palletized for handling and storage, and have superior stacking strength, with a top to bottom compression of 6,000 pounds, and may be stacked three high with a safety factor of 5:1. They are easily and fully recyclable and when empty the containers may be shipped and stored in a knocked-down or flattened condition, although they can be shipped in fully assembled condition, if desired. The containers may be lifted and carried by engaging the tines of a forklift under the rim at the top of the bin, and they may be manually moved by tilting and rolling them on their bottom edge. The rim at the top of the container provides a more secure surface for engagement with the tines of a forklift, and better gripping and control when the containers are being manually moved by tilting and rolling them on their bottom edge. Further, the plurality of short straight sides or surfaces provided by the multi-sided construction retards the build-up of momentum or inertia when the containers are tilted and rolled on their bottom edge, thereby enhancing control over the containers when they are being moved manually.

Although the containers described in applicant's above-noted prior co-pending patent applications meet or exceed the requirements for normal use, they may not meet the UN/DOT regulations for use in hazardous waste disposal. In order to be fully certified under UN/DOT regulations for use in hazardous waste disposal, the drum needs to pass a series of 48" drops while containing 500 lbs of material. Under these extreme conditions the lid in conventional containers could become dislodged from the bin.

Accordingly, there is a need for an affordable, recyclable, functional bulk container for liquids and semi-liquid fluids that has the advantages of a cylindrical drum but that is free of the disadvantages, and that has a lid that resists dislodgement when the container is tipped over or dropped. In particular, it would be desirable to have a container as above that meets or exceeds the UN/DOT regulations for use in hazardous waste disposal.

SUMMARY OF THE INVENTION

The basic form of container according to the invention comprises a multi-sided bin or case with a closed bottom and an open top, and a lid for placement over the open top, wherein an integral rim defining downwardly facing shoulders is provided at the top of the bin and the lid has an elongated skirt that extends downwardly past the shoulders, with a clamping band placed around the skirt below the shoulders to securely hold the lid in place on the bin. This form of the invention could be used, for example, when the product placed in the container poses little risk of leakage. When liquid or semi-liquid materials are placed in the bin, a bag can be placed in the bin to contain the product. A container incorporating a lid according to the invention can have four, six, or eight sides, or any number of sides suitable for the intended use.

In a preferred embodiment the container is in drum form made of corrugated fiberboard for shipping liquids and semi-liquid fluids and that generally looks, handles, stores, ships, and can be received like the fiber, plastic or steel cylindrical drums conventionally used but that is free of the disadvantages. The bin preferably is octagonal in shape, with eight relatively narrow straight sides, and preferably is made of triplewall corrugated fiberboard. The relatively narrow side panels of the octagonal shape provide superior flexural rigidity and stacking strength, and also results in a plurality of relatively short straight surfaces in a circumferential direction of the container, facilitating manual rolling of the container on its bottom edge. An outer rim at the upper end of the bin follows the contour of the octagonal shape and forms a plurality of straight sections presenting downwardly facing shoulders. A lid with an elongated depending skirt is placed over the open top of the bin, with the skirt extending down over the upper end of the bin to below the downwardly facing shoulders of the rim, and a clamping band is placed around the skirt below the shoulders to securely hold the lid in place on the bin. Inwardly bendable locking strips on the lid skirt can be pressed into notches in the outer surface of the rim to hold the lid in proper position while the clamping band is being secured. The bottom of the bin is constructed so that it is strong and leak-resistant and preferably so that it provides a flat smooth surface on both the interior and exterior of the bin.

In a further preferred embodiment, especially for handling liquids and/or hazardous materials, a tray is placed in the bottom of the octagonally shaped bin and a liner insert rests at its bottom end in the tray and extends upwardly in close fitting relationship in the bin sidewall from the bin bottom to the bin top. A fluid-containing bag is confined within the liner insert and is closed at its top. This embodiment of the invention is especially suited for hazardous waste disposal, and meets the UN/DOT regulations for a container used in hazardous waste disposal. The lid, liner and tray may be of single wall construction or other suitable construction as desired or necessary.

The preferred embodiment of the invention may be manually rolled on its bottom edge. It has superior stacking strength, with a top to bottom compression of 6,000 pounds, and may be stacked three high with a safety factor of 5:1.

The container of the invention is easily and fully recyclable and when empty it may be shipped and stored in a knocked-down or flattened condition, although it can be shipped in fully assembled condition, if desired. The container can be provided in a variety of sizes and footprints, and preferably is designed with a footprint so that four of the containers fit side-by-side on a 40×48, 45×48 or 44×44 inch pallet. To fit on the different size pallets, the footprint of the container could be selected as necessary and the height changed, for example, to accommodate a desired capacity.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
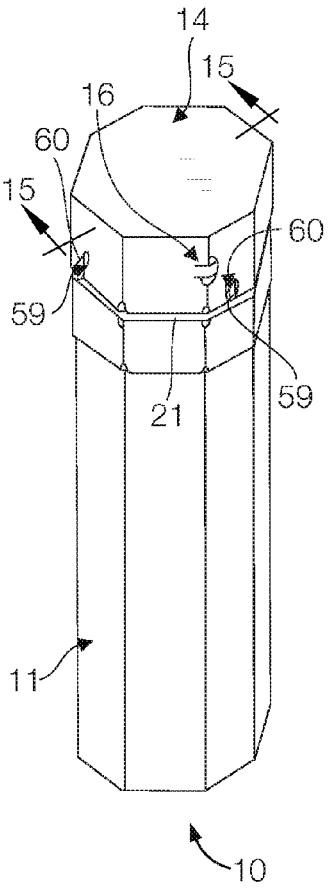
FIG. 1 is a top perspective view of a container according to the invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
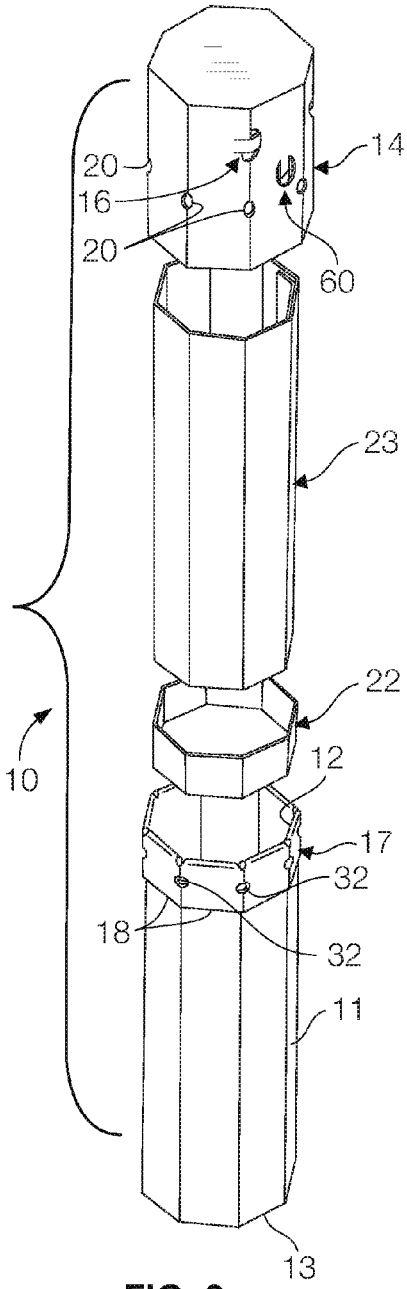
FIG. 2 is an exploded perspective view of the bin, tray, liner and lid according to a preferred form of the invention.

A container according to a preferred embodiment of the invention is indicated generally at 10 in FIGS. 1 and 2. The container comprises a bin or case 11 with an open top 12, a closed bottom 13, and a cover or lid 14 closing the open top. In this preferred embodiment the bin is octagonal and has eight sidewall panels **15*a*-15*h* (see FIG. 3). As described in more detail hereinafter, a locking feature 16 is provided on the lid and the bin to lock the lid in position on the bin. As seen best in FIGS. 2-7 and 11, a rim 17 extends around the upper end of the bin and comprises a series of short straight sections 17***a*-17*h* each having a length substantially the same as the width of the associated sidewall panel and presenting downwardly facing shoulders 18. The lid 14 comprises an octagonally shaped top panel 19 with a plurality of elongated skirt panels 14*a*-14*h* joined to respective side edges thereof and defining a depending lid skirt that extends downwardly over the top end of the bin beyond the shoulders 18. Aligned cut-outs 20 in adjacent side edges of the panels 14*a*-14*h* form areas for receiving a clamping band 21 that is cinched around the skirt just below the shoulders 18 to securely hold the lid to the bin. Although the bin and lid shown in these figures have eight sides, a bin and associated lid according to the invention could have four, six or any other number of sides as desired and appropriate for the intended use, so long as the bin has an outwardly projecting rim at its upper end defining a downwardly facing shoulder and the lid has a depending skirt that extends below the shoulder and is cinched inwardly against the sides of the bin by a clamping band tightened around the skirt just below the shoulder.

With reference to FIG. 2, which shows a further preferred embodiment, a tray insert 22 is placed in the bottom of the bin, and an open-ended sleeve or liner insert 23 is seated in the tray and extends substantially the full height of the bin. The tray fits closely in the sidewall of the bin, and the bottom end of the liner fits closely in the tray. The container may be used without the tray and liner, but their use ensures a leak-proof container, especially when liquids or semi-liquids are placed in it. The tray and liner also preferably are used when hazardous materials are placed in the container.

Figure 3:
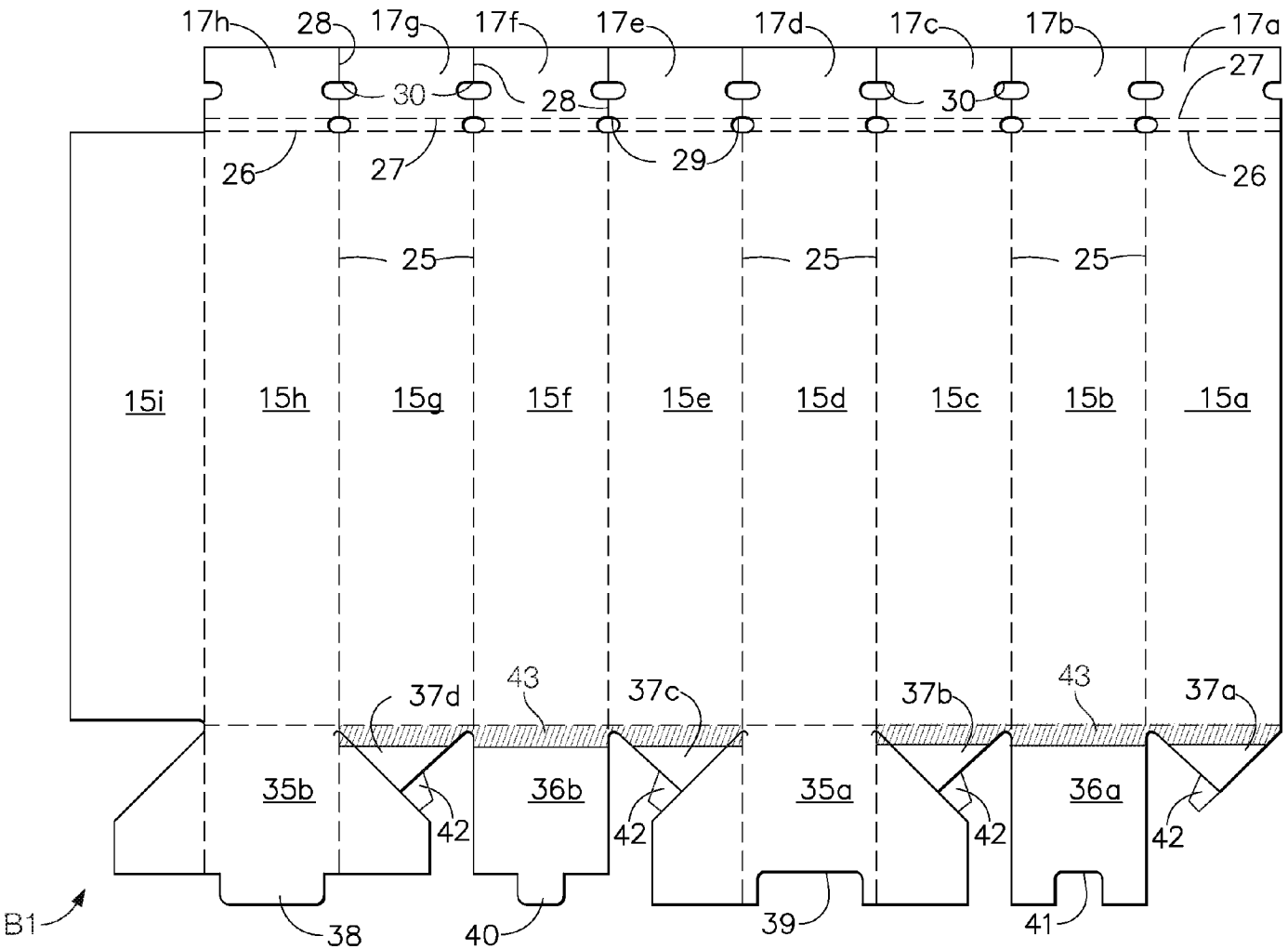
FIG. 3 is a plan view of a blank for making the bin according to a preferred embodiment of the invention.
Figure 4:
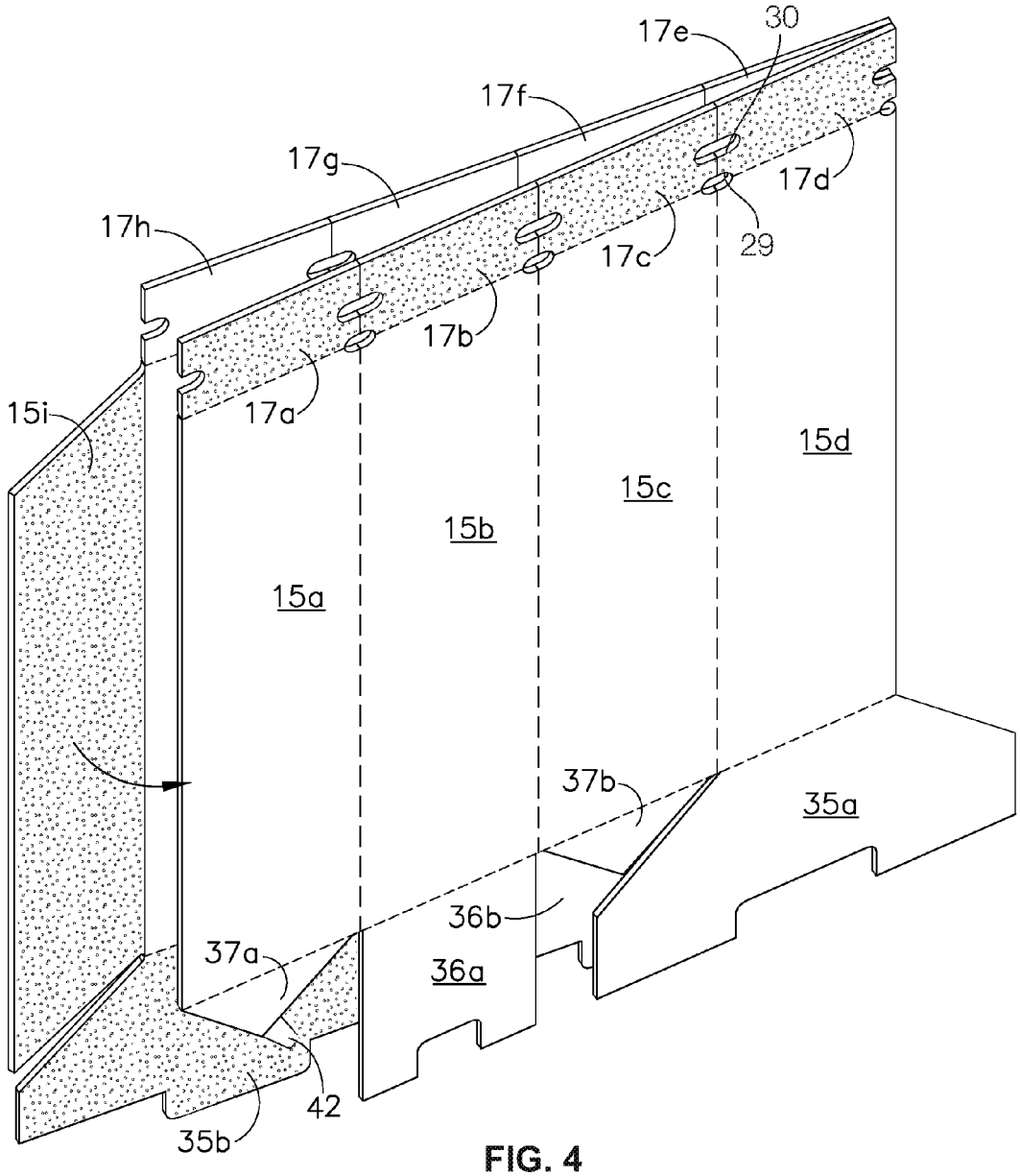
FIG. 4 is a perspective view showing the blank of FIG. 3 folded onto itself and depicting the glue panel in partially folded position.
Figure 9:
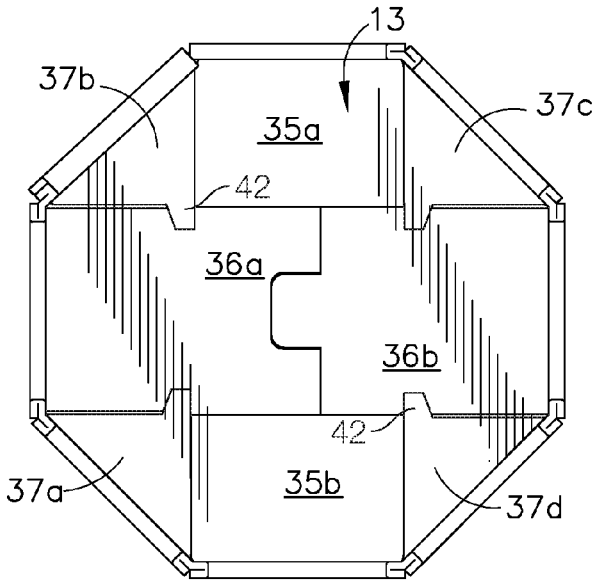
FIG. 9 is a plan view of the interior of the bottom of the bin, showing the smooth flat interior bottom surface provided by the bottom flaps after they have been folded and secured to one another.
Figure 10:
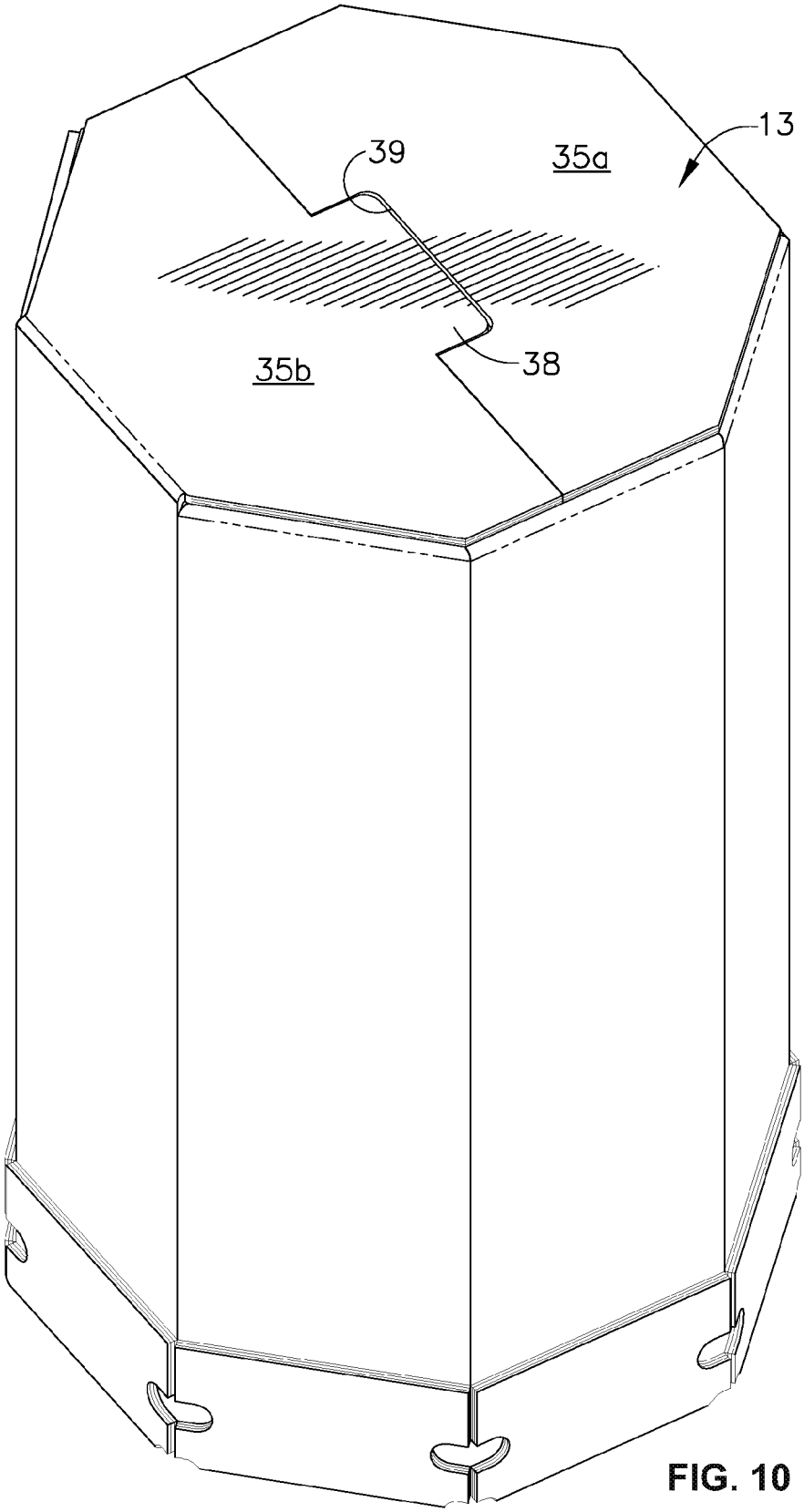
FIG. 10 is a fragmentary perspective view showing the smooth flat outer bottom surface of the bin when the bottom flaps are fully folded and secured together.
Figure 11:
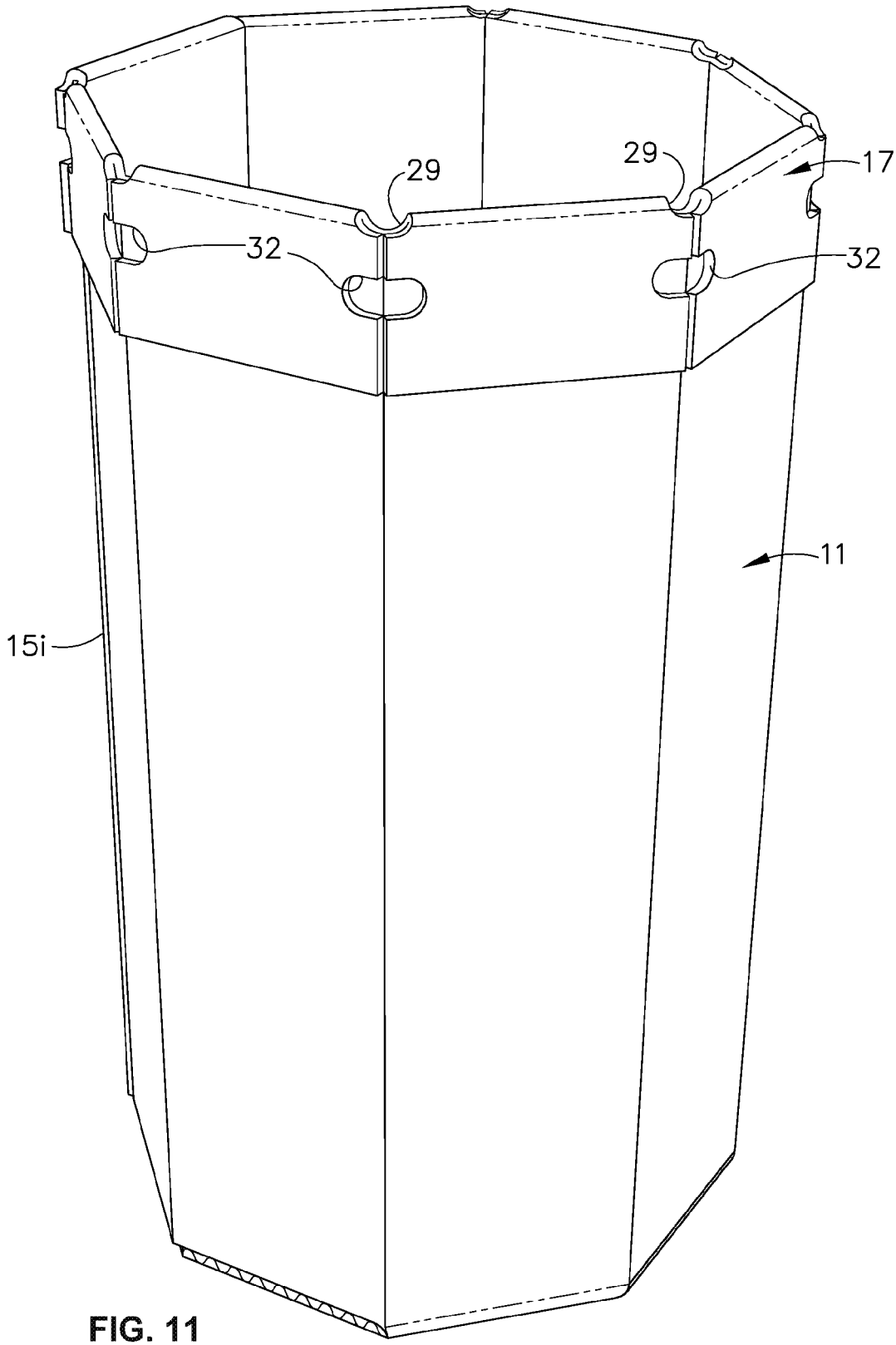
FIG. 11 is a top perspective view of a completed bin according to the preferred embodiment.

A blank B1 for making a preferred embodiment of the bin of the invention is illustrated in FIG. 3 and is shown being erected into a completed bin in FIGS. 4-11. The blank has eight substantially identical elongate rectangular sidewall-forming panels 15*a*-15*h* joined together along spaced parallel fold scores 25, and a substantially identical panel 15*i* at one end of the blank forming a glue panel. To form the bin, the blank is first folded onto itself as shown in FIG. 4, and the glue panel 15*i* is overlapped with and glued to wall-forming panel 15*a*. Rim-forming flaps 17*a*-17*h* are foldably joined to one end of the respective panels 15*a*-15*h* along a double fold score 26, 27, and are separated from one another by cuts 28. The area between the scores 26, 27 is crushed and a series of small stress relieving cutouts 29 are made at the base of the cuts 28 and between the scores 26, 27, extending slightly into the ends of scores 25 to prevent tearing of the material when the flaps are folded 180 degrees to lie against the outer surface of the side panels as seen in FIGS. 2 and 5-7. A series of second cutouts 30 are made in the flaps 17*a*-17*h*, extending across approximately the midpoint of the cuts 28, defining recessed areas or notches 32 extending across each corner of the rim 17 in a container erected from the blank, as seen in FIGS. 2 and 11. These notches define part of the lid locking structure mentioned previously.

Figure 8:
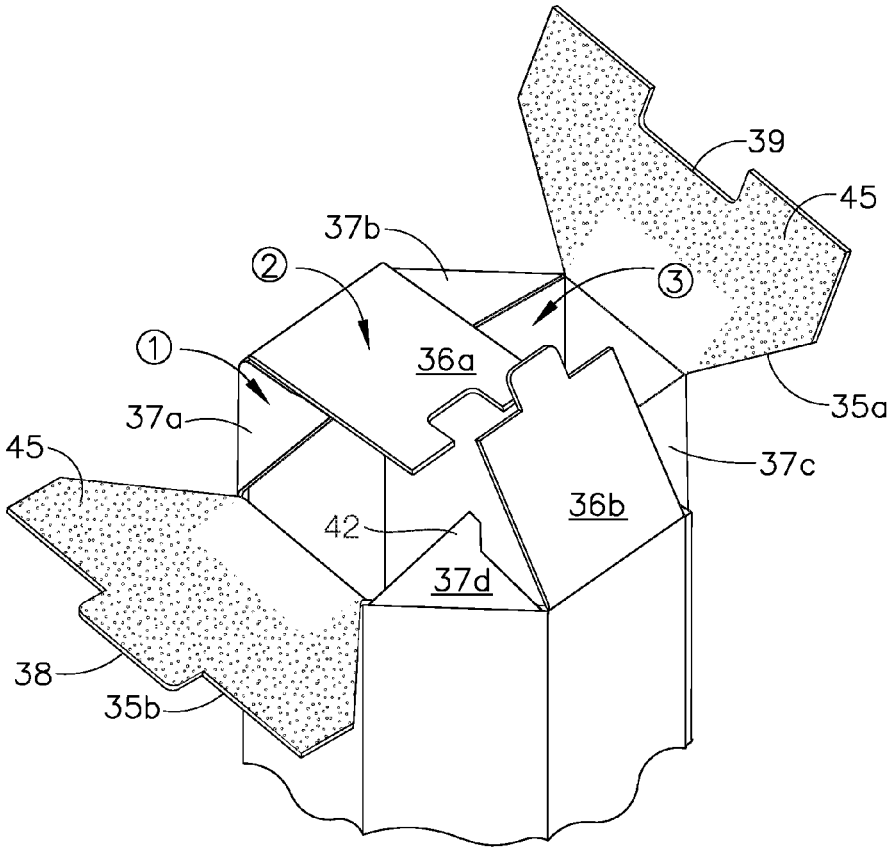
FIG. 8 is a fragmentary perspective view of the bottom end of the bin, showing the bottom flaps being folded into operative position.

Bottom-forming flaps are foldably joined along the edge of the blank opposite the rim-forming flaps 17*a*-17*h*, and include a pair of generally trapezoidally shaped major bottom flaps 35*a* and 35*b* that are disposed in opposed relationship to one another when a bin is erected from the blank, a pair of rectangularly shaped minor bottom flaps 36*a* and 36*b* that are in opposed relationship to one another and disposed orthogonally to the flaps 35*a* and 35*b* when the bin is erected, and intermediate triangularly shaped flaps 37*a*-37*d* attached to the side panels 15*a*, 15*c*, 15*e* and 15*g* located between the side panels carrying the major and minor flaps. The outer end edge of one of the major bottom flaps has an outwardly projecting tab 38 and the outer end edge of the opposite major bottom flap has a complementary notch 39. Similarly, the outer end edge of one of the minor bottom flaps has an outwardly projecting tab 40 and the outer end edge of the opposite minor bottom flap has a complementary notch 41. These tabs and notches serve as an aligning feature when the bin is being set up from its knocked-down of folded flat condition, as depicted in FIGS. 8-10. Small assembly tabs 42 are formed near the apex of each flap 37*a*-37*d* on the side edge thereof facing a minor flap 36*a* or 36*b*. As explained hereinafter, these assembly tabs aid in erecting the bin from its flattened condition. Further, the material of the blank is crushed along narrow bands 43 at the base of the bottom flaps 36*a*, 36*b* and 37*a*-37*d* to reduce the memory of their folded connection and aid in folding the bottom panels into their operative positions.

Figure 5:
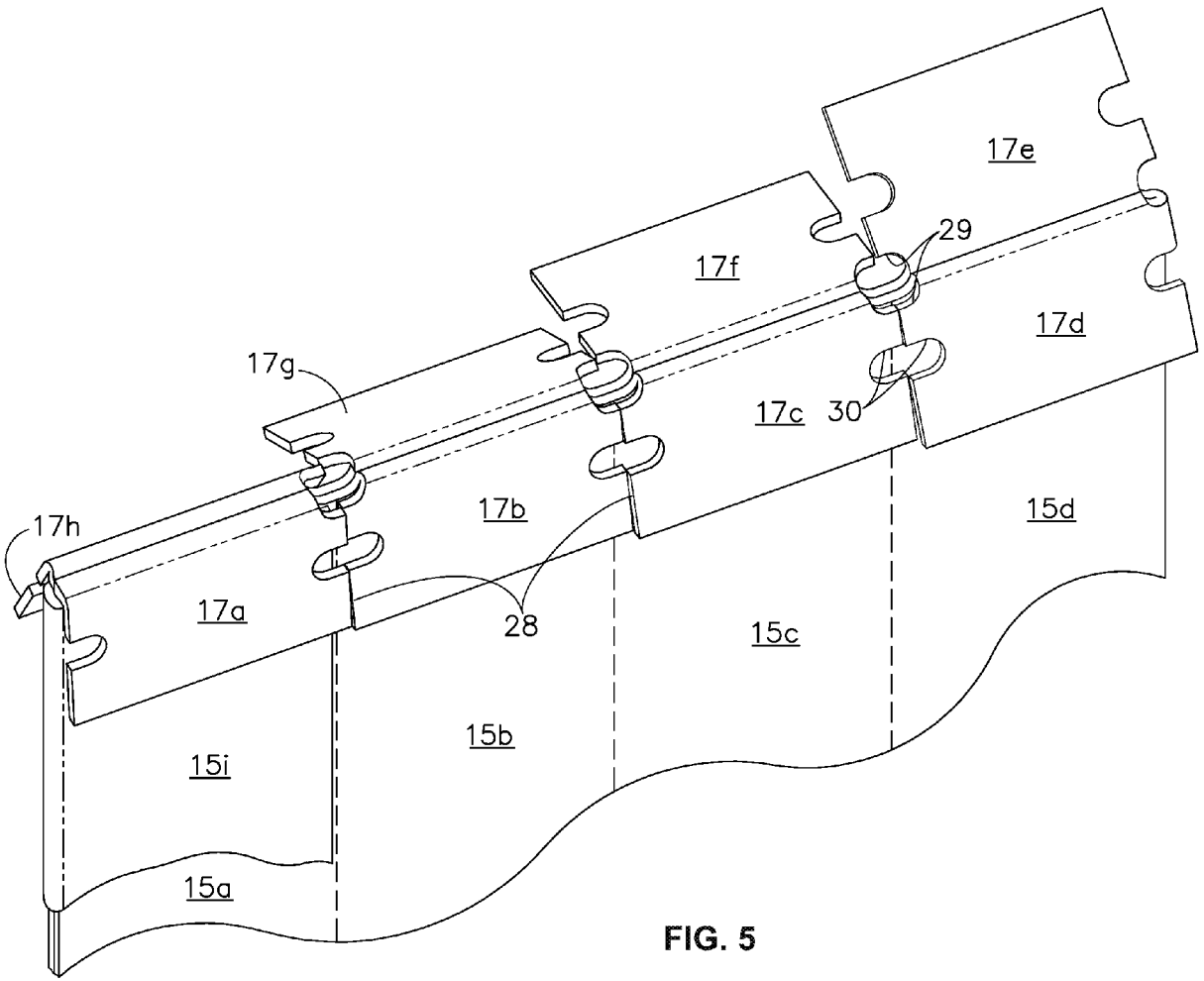
FIG. 5 is a fragmentary perspective view of the blank of FIG. 3 showing the glue panel in glued position and depicting the top flanges being folded and secured to the sidewall to form the rim at the top of the container.
Figure 6:
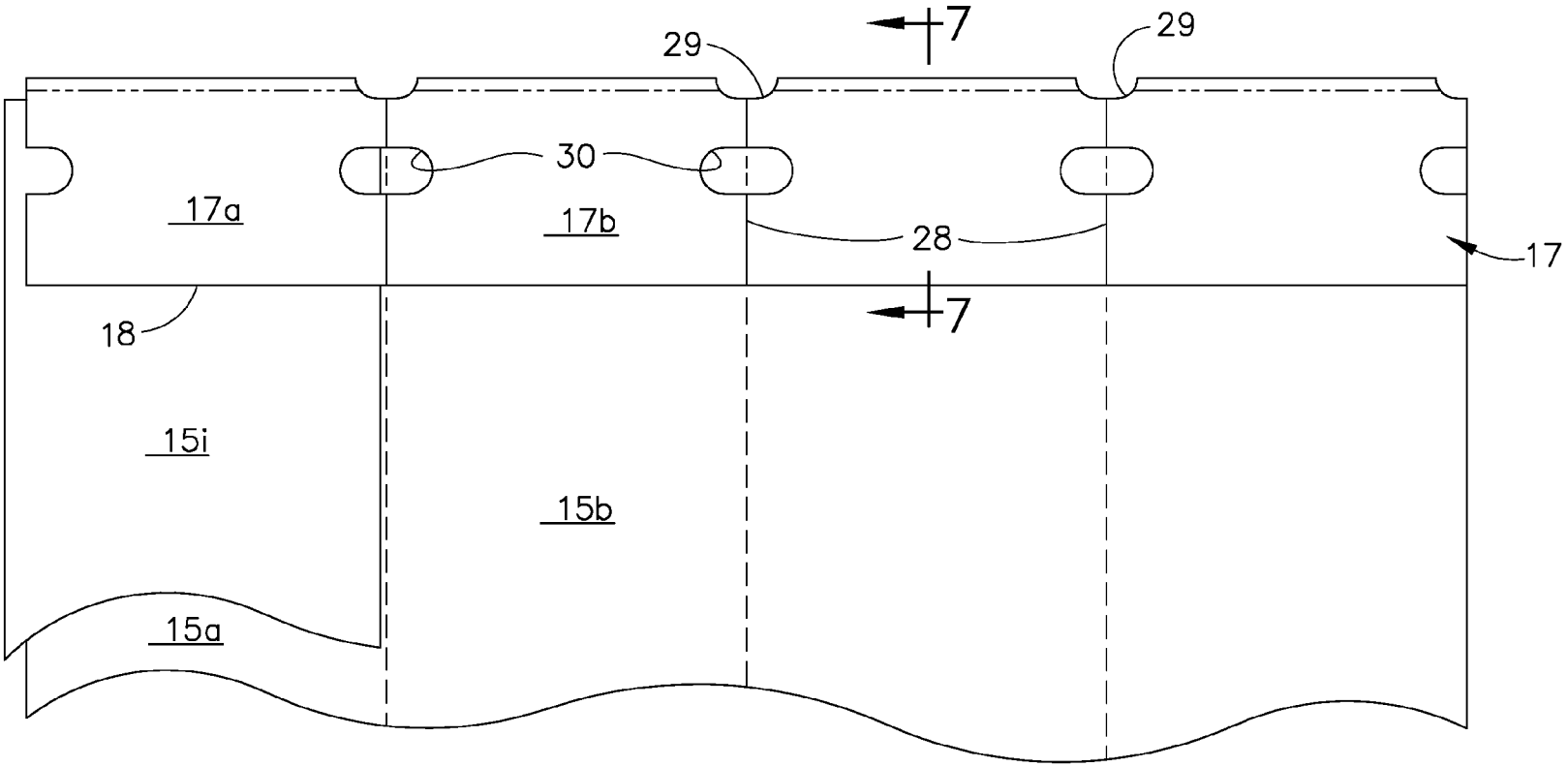
FIG. 6 is a fragmentary side view in elevation of the blank of FIG. 4, with the top flaps fully folded against and secured to the sidewall to form the rim.
Figure 7:
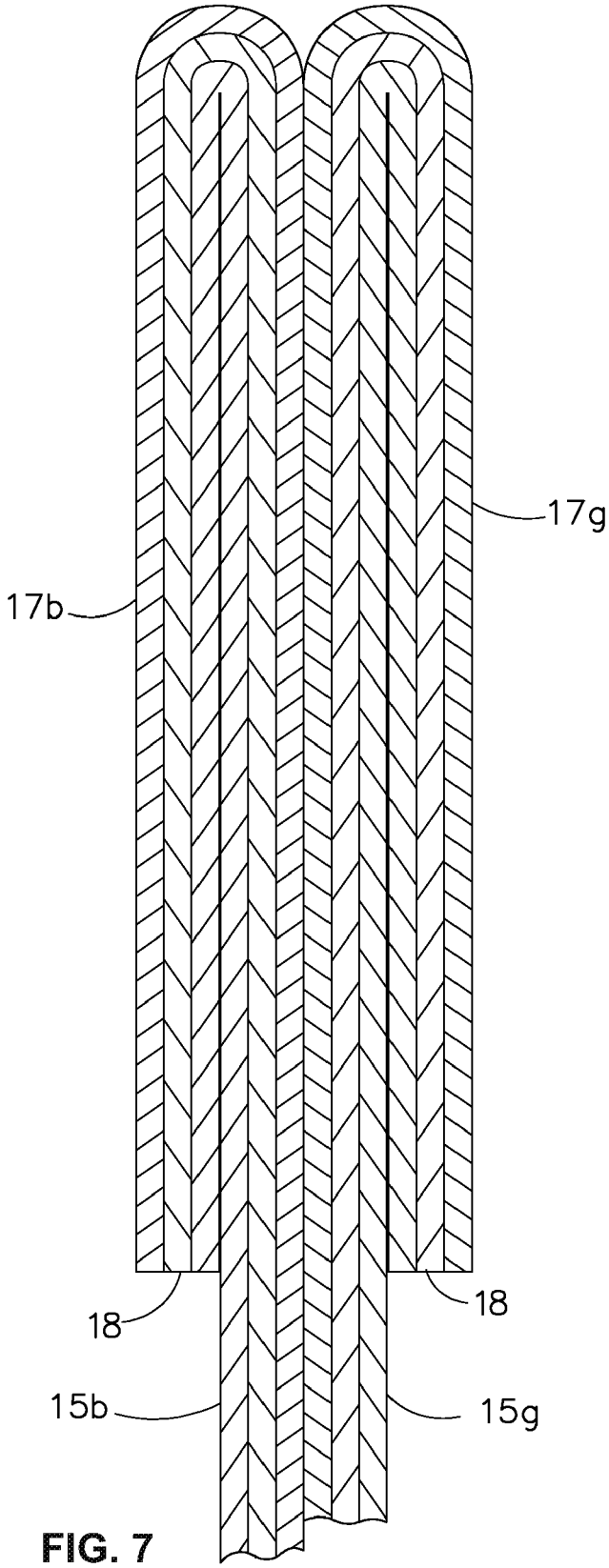
FIG. 7 is an enlarged fragmentary sectional view taken along line 7-7 in FIG. 6.

To erect the bin from the blank B1, the blank is folded in half and the glue panel 15*i* is adhesively attached in overlapping relationship to sidewall panel 15*a* as depicted in FIG. 4. The rim-forming flaps 17*a*-17*h* are then folded through 180° and secured to the upper outer surface of the respective sidewall panels 15*a*-15*h* as depicted in FIGS. 5-7. The flaps 17*a*-17*h* preferably are secured in their folded relationship against the sidewall panels with an adhesive, but other means of attaching the flaps to the sidewalls may be used if desired and/or appropriate. The bin is then opened up into a tubular configuration as shown in FIG. 8, and the intermediate flaps 37*a*-37*d* are first folded inwardly, followed by inward folding of the minor bottom flaps 36*a* and 36*b*. It will be noted that the small tabs on the flaps 37*a*-37*d* are caught beneath the minor flaps 36*a* and 36*b*, whereby the flaps 37*a*-37*d* are held in their inward folded positions. The major bottom flaps 35*a* and 35*b* are then folded inwardly, with tab 38 engaged in notch 39. When the flaps are all folded inwardly over the bottom of the bin, the major bottom flaps completely overlap both the minor bottom flaps and the intermediate bottom flaps, and as indicated by the shaded areas in FIG. 8 adhesive 45 is applied to the major bottom flaps over the entire area where they overlap the other bottom flaps. The tabs and notches on the ends of the major and minor bottom flaps serve to align the flaps into proper relationship with one another and to square up the bin. Further, the size and shape of the bottom-forming flaps produces a flat smooth surface on both the interior and exterior of the bin, as depicted in FIGS. 9 and 10, wherein FIG. 9 is a plan view of the interior surface of the bottom and FIG. 10 is a perspective view of the outer surface.

FIG. 11 is a top perspective view of a fully erected bin 11 in accordance with the invention.

Figure 12:
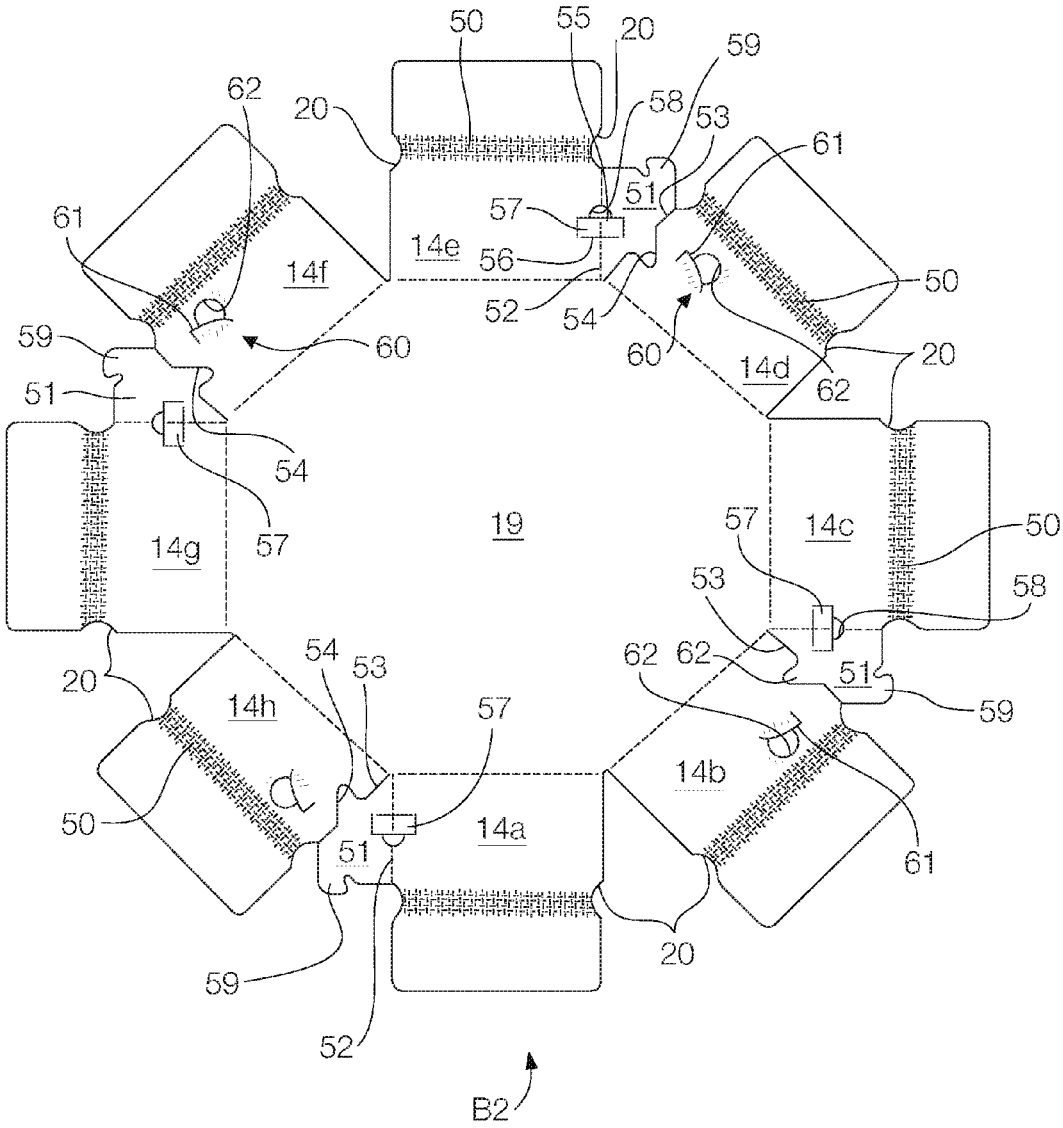
FIG. 12 is a plan view of a blank for making a lid according to the invention.

A blank B2 for making the lid according to the invention is shown in FIG. 12. The blank B2 as shown is configured for use with that form of bin having eight sides, but by eliminating some of the sides and corresponding skirt flap panels, or adding to them, it could be adapted for use with a bin having a different number of sides, as previously indicated. The blank comprises an octagonally shaped top panel 19 with elongated skirt panels 14*a*-14*h* foldably connected to respective side edges of the skirt panel. Aligned confronting cut-outs 20 are formed in adjacent side edges of the skirt panels approximately midway of their length and a band 50 of the material of each skirt panel is crushed across its width between the cut-outs.

Figure 13:
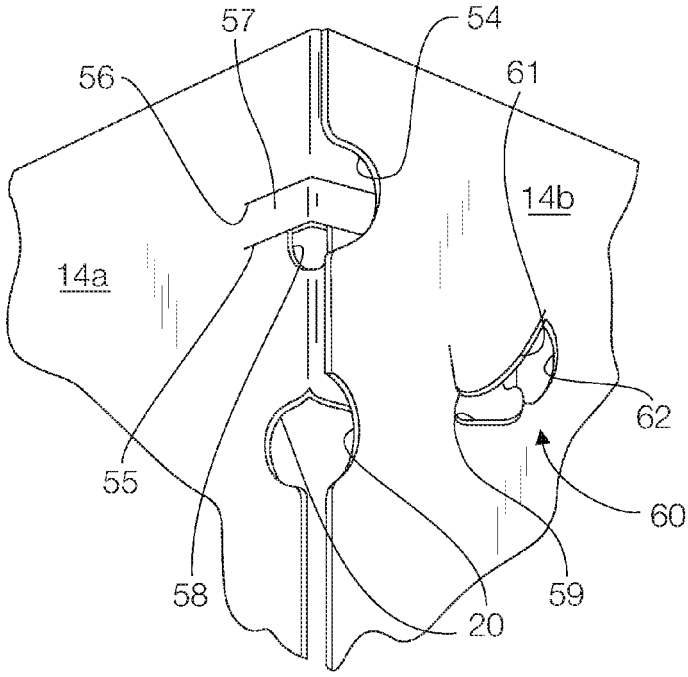
FIG. 13 is a fragmentary exterior perspective view of one corner of the lid according to the invention, showing the relative positions of the bendable locking strip, cut-outs for receiving the clamping band, and interfitting shaped opening and locking tongues on adjacent lid skirt panels for holding the skirt panels in operative position for placement on the bin.
Figure 14:
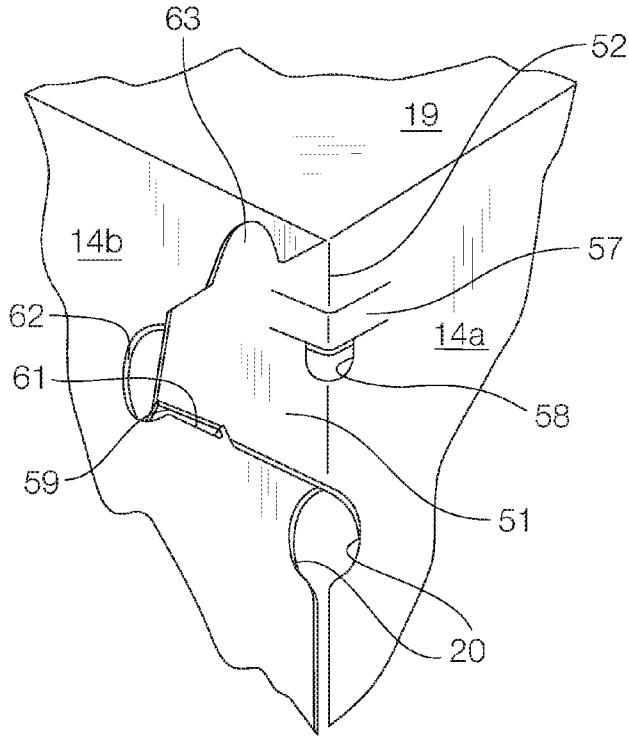
FIG. 14 is a fragmentary interior perspective view of that corner of the lid shown in FIG. 13, showing further details of the locking tongue and shaped opening.
Figure 15:
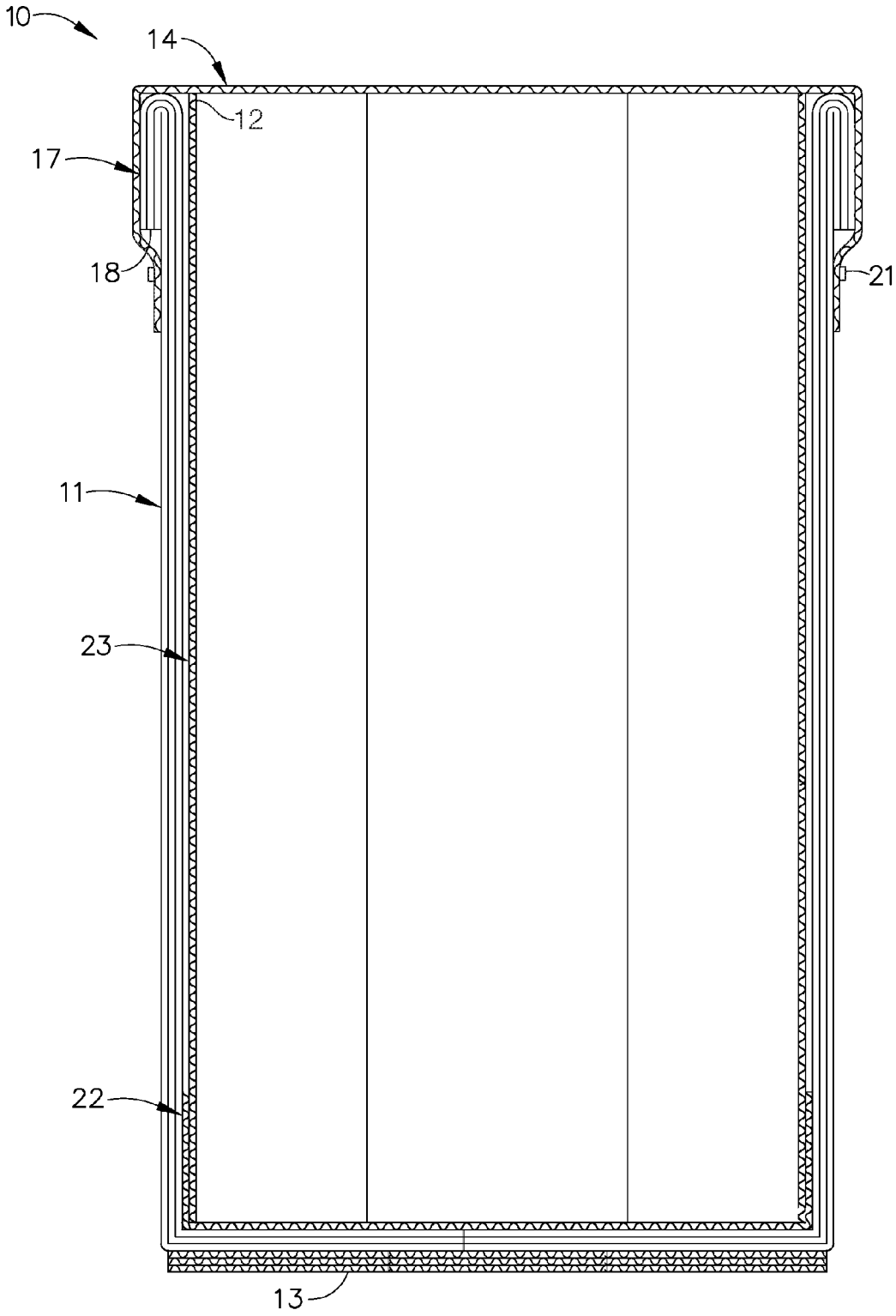
FIG. 15 is a longitudinal cross-sectional view of a fully assembled container according to a preferred form of the invention, taken along line 15-15 in FIG. 1.
Figure 17:
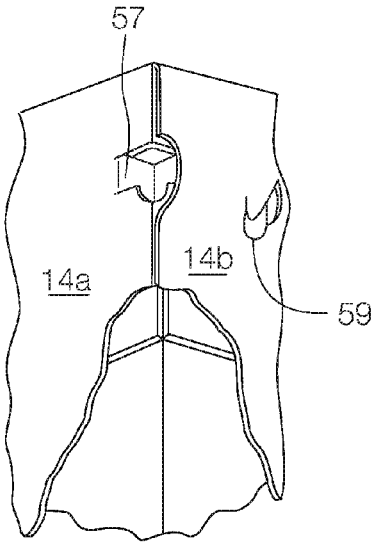
FIG. 17 is a bottom fragmentary perspective view showing the lid of FIG. 16 in position on the bin and showing one of the bendable locking strips pressed into a notch in the outer surface of the rim at the top of the bin.
Figure 16:
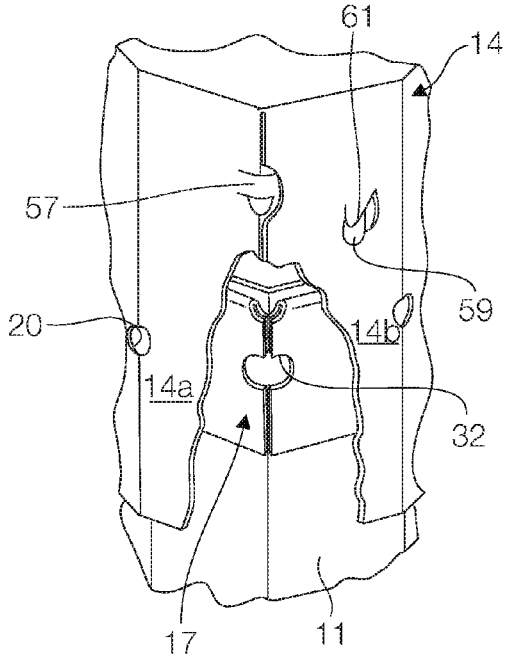
FIG. 16 a fragmentary top perspective view showing a lid according to the invention being placed on a bin according to a preferred embodiment of the drum of the invention.

A locking flap 51 is formed on one side edge of alternate skirt panels 14*a*, 14*c*, 14*e* and 14*g*, joined to the respective skirt panel along a fold 52 that extends from the cut-out 20 in the side edge of that skirt panel to the folded connection of the skirt panel with the top panel. Each locking flap is separated from an adjacent skirt panel by a cut 53 that is shaped to form a cut-out 54 in the edge of that panel. A pair of spaced parallel cuts 55 and 56 is made across the folded connection 52 of each locking flap, forming the bendable locking strips 57. As seen best in FIG. 13, the cut-outs 54 provide access to the bendable locking strips when it is desired to push them inwardly into an aligned notch in the rim of a bin on which the lid is being secured. A small semi-circular cut-out 58 is formed adjacent each locking strip to provide a finger access to pull the locking strip out of an associated notch, when desired. Each locking flap has a projecting locking tongue 59 on its outer end edge for engagement in a locking slot as described below to lock the skirt flaps in their downwardly folded positions shown in FIGS. 1, 2 and 13-17.

The skirt panels 14*b*, 14*d*, 14*f* and 14*h* interposed between the panels having the locking flaps thereon each has a locking slot 60 formed therein adjacent the crushed band 50 and spaced inwardly from the side edge facing the locking flap on an adjacent skirt panel. The locking slots each comprise an arcuate generally hook-shaped cut 61 and a part circular cut-out 62 contiguous with the convex side of the arcuate cut 61, adjacent but spaced slightly from the end of the cut 61 opposite the hooked end. As indicated by the shaded area on the concave side of the cuts 61, a small area adjacent the cuts may be crushed to facilitate insertion of the locking tongue into the locking slot. As seen best in FIG. 14, the shaped cut 53 that forms cut-out 54 also forms a protruding tab 63 on the edge of the locking flap, and that tab lies against the inner surface of an adjacent skirt panel when the lid is folded into operative position. The shaped cut 61 and cut-out 62 facilitate assembly of the lid into its operative condition by providing a clearance tolerance for the locking tongue to be inserted into the shaped cut and then moved to a locked position at the hooked end of the cut.

To erect the blank B2 into the lid of the invention, the skirt panels 14*a*-14*h* are folded into downwardly extending relationship next to one another as shown in FIGS. 1, 2, 13, 14, 16 and 17, with the locking flaps 51 folded inwardly to lie behind an adjacent skirt panel. The locking tongues 59 are then inserted through the locking slots 60 into the locked position shown in FIGS. 13 and 14.

To secure the lid 14 on a bin 11 according to the invention, the erected lid is placed down over the open top of the bin until the bendable locking strips 57 in the lid skirt are in registry with the notches 32 in the rim 17. The bendable locking strips 57 are then pressed inwardly into the notches 32 to hold the lid in position while the clamping band 21 is being placed. The clamping band preferably is positioned in the cut-out areas 20 and then tightened. The crushed bands 50 in the skirt panels prevent the lower ends of the panels below the clamping band from deforming outwardly when the band is tightened.

In a particular construction according to the invention the rim 17 has a width of about 4 inches from the top of the bin to the shoulder at the bottom of the rim, and the depending lid skirt panels have a length of about 5 inches from their folded connection with the lid top panel to the crushed band 50 extending across the panels. It should be understood, however, that these dimensions could vary, depending upon the capacity of the bin and other factors desired or necessary for the particular intended use of the bin. The important factors are that the rim has a substantial width and thickness, defining a downwardly facing shoulder on the exterior sidewall of the bin near its top end, and the lid has an elongated depending skirt that extends downwardly past the shoulder and is secured to the bin by a clamping band cinched around the lid skirt just below the location of the shoulder.

Figure 18:
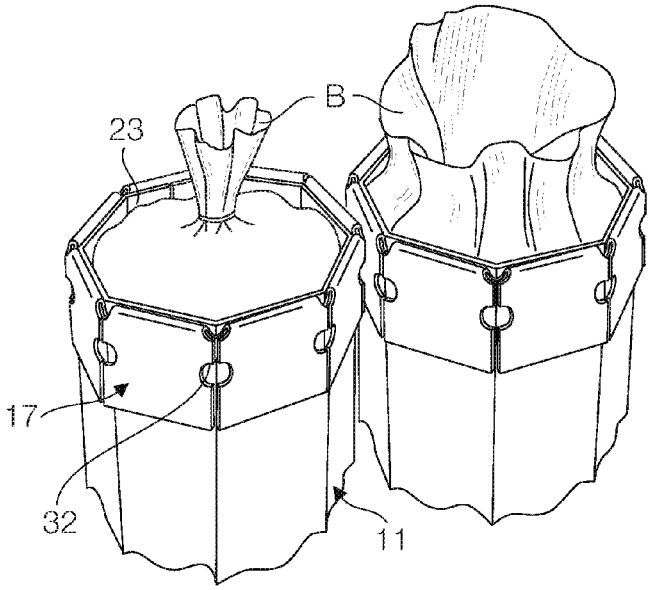
FIG. 18 shows an optional bag that may be placed in the container to hold liquids.

As shown in FIG. 18, a fluid-containing bag B may be placed in the bin to contain fluid materials, e.g. liquids. The bag may be used in lieu of the tray and liner insert or in combination therewith. Particularly when a bag is used in combination with the tray and liner insert the container is suitable for use in waste disposal.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A bulk container for storing, shipping and dispensing liquid and semi-liquid fluids, comprising:

a bin having a sidewall, a closed bottom end, and an open top end, the sidewall comprising a plurality of interconnected sidewall panels extending at an angle with respect to one another;

an integral rim formed on said open top end, said integral rim forming a downwardly facing shoulder wherein notches are formed in the integral rim at corners of the bin;

a lid covering the open top end of the bin, said lid having an elongated depending skirt that extends downwardly past said shoulder wherein bendable locking strips are formed in the elongated depending skirt of the lid in positions to be in registry with the notches when the lid is in place on the bin, the bendable locking strips and notches forming a lid locking means when the strips are pushed inwardly into the notches; and a clamping band clamped around said lid skirt below said shoulder to secure said lid on said bin.

2. The bulk container of claim 1, wherein:

a liner insert is disposed in the container, said liner insert fitting tightly in the bin sidewall and extending from the bin closed bottom to the bin open top.

3. The bulk container of claim 2, wherein:

a tray is disposed in the bin closed bottom, and said liner insert sits in said tray.

4. The bulk container of claim 1, wherein:

a fluid-containing bag is supported in the bin.

5. The bulk container of claim 3, wherein:

a fluid-containing bag supported in the bin, said bag being confined within the liner insert.

6. The bulk container of claim 1, wherein:

said rim comprises an outwardly and downwardly folded rim flap on an upper edge of each sidewall panel, the rim flaps being secured to an upper outer surface of a respective said sidewall panel in contiguous parallel relationship thereto and each presenting a downwardly facing shoulder having a length substantially the same as the width of an associated said sidewall panel and a thickness defining a substantial said shoulder.

7. The bulk container of claim 5, wherein:

said rim comprises an outwardly and downwardly folded rim flap on an upper edge of each sidewall panel, the rim flaps being secured to an upper outer surface of a respective said sidewall panel in contiguous parallel relationship thereto and each presenting a downwardly facing shoulder having a length substantially the same as the width of an associated said sidewall panel and a thickness defining a substantial said shoulder.

8. The bulk container of claim 1, wherein:

said depending lid skirt comprises a top panel and a plurality of elongated skirt panels depending therefrom and corresponding in number to the number of bin sidewall panels, a said skirt panel lying against each said sidewall panel and each having the same width as an associated sidewall panel.

9. The bulk container of claim 8, wherein:

first said depending skirt panels have a locking flap formed on a side edge thereof; and second said depending skirt panels adjacent said first panels have a locking slot formed therein, each said locking flap being received in an associated locking slot to lock said depending skirt panels in operative downwardly folded position.

10. The bulk container of claim 9, wherein:

said rim comprises an outwardly and downwardly folded rim flap on an upper edge of each sidewall panel, the rim flaps being secured to an upper outer surface of a respective sidewall panel in contiguous parallel relationship thereto and each presenting a downwardly facing shoulder having a length substantially the same as the width of an associated sidewall panel and a thickness defining a substantial said shoulder.

11. The bulk container of claim 10, wherein:

the bin is octagonally shaped, with eight interconnected said sidewall panels and associated said rim flaps.

12. The bulk container of claim 11, wherein:

a bin tray is in the bin, the bin tray fitting closely in the bottom of the bin; and a liner insert fits closely at a bottom end thereof in the bin tray and extends at an opposite end thereof to adjacent the upper end of the bin in closely fitting relationship against the sidewall of the bin.

13. The bulk container of claim 10, wherein:

notches are formed in the rim at corners of the bin; and bendable locking strips are formed in the skirt of the lid in positions to be in registry with the notches when the lid is in place on the bin, the bendable locking strips and notches forming a lid locking means when the strips are pushed inwardly into the notches.

14. The bulk container of claim 13, wherein:

said locking slots each comprise a generally arcuate hook-shaped cut with a cut-out contiguous thereto adjacent one end thereof.

15. The bulk container of claim 1, wherein:

said rim comprises an outwardly and downwardly folded rim flap on an upper edge of each sidewall panel, the rim flaps being secured to an upper outer surface of a said respective sidewall panel in contiguous parallel relationship thereto and each presenting a downwardly facing shoulder having a length substantially the same as the width of an associated said sidewall panel and a thickness defining a substantial said shoulder;

said depending lid skirt comprises a top panel and a plurality of elongated skirt panels depending therefrom and corresponding in number to the number of bin sidewall panels, a said skirt panel lying against each said sidewall panel and each having the same width as an associated said sidewall panel;

first said depending skirt panels have a locking flap formed on a side edge thereof, and second said depending skirt panels adjacent said first panels have a locking slot formed therein, each said locking flap being received in an associated said locking slot to lock said depending skirt panels in operative downwardly folded position;

aligned cut-outs are formed in adjacent side edges of said skirt panels in locations to be spaced below said rim shoulder; and a clamping band is clamped around said lid skirt in said aligned cut-outs to secure said lid to said bin.

16. The bulk container of claim 15, wherein:

said locking slots each comprise a generally arcuate hook-shaped cut with a cut-out contiguous thereto adjacent one end thereof; and said locking flaps each have a locking tongue projecting therefrom, said locking tongues being received in respective said locking slots.

17. The bulk container of claim 16, wherein:

the bin is octagonally shaped, with eight interconnected said sidewall panels and associated said rim flaps.

18. A blank for making a lid to cover an open end of a multi-sided bulk bin, said blank comprising:

a top panel having a number of sides corresponding to the number of sides of the multi-sided bulk bin;

an elongated lid skirt panel depending from each side of said top panel;

a cut-out in each of the opposite sides of each said skirt panel approximately midway of the length of each panel;

the material of said skirt panels being crushed along a band extending across the width of each said skirt panel between the cut-outs in opposite side edges thereof;

a locking flap formed on a side edge of at least one said skirt panel; and a locking slot formed in an adjacent said skirt panel to receive a said locking flap when the skirt panels are folded into operative position.

19. The blank of claim 18, wherein:

each locking flap is joined to an associated skirt panel along a fold; and a pair of spaced parallel cuts extend across said fold approximately midway between a said cut-out and the folded connection of said skirt panel with said top panel, said spaced cuts defining a bendable locking strip.

* * * * *